United States Patent [19]

Uemura et al.

[11] Patent Number: 4,986,345

[45] Date of Patent: Jan. 22, 1991

[54] ROTARY HEAT EXCHANGER

[75] Inventors: Masakazu Uemura, Yokosuka; Yoshinori Hirano, Yokohama; Hitoshi Shimonosono, Yokosuka, all of Japan

[73] Assignee: Nissan Motor Co., Ltd., Japan

[21] Appl. No.: 306,567

[22] Filed: Feb. 6, 1989

[30] Foreign Application Priority Data

Feb. 9, 1988 [JP] Japan ..... 63-15165[U]

[51] Int. Cl.[5] ..... F01P 3/18; F28F 5/04

[52] U.S. Cl. ..... 165/86; 165/41; 165/51; 165/121; 165/181; 123/41.48

[58] Field of Search ..... 165/41, 51, 86, 121, 165/181, 182, 76, 146, 184, 44; 123/41.48

[56] References Cited

U.S. PATENT DOCUMENTS

| | | | |
|---|---|---|---|
| 2,216,778 | 10/1940 | Houdry | 165/182 |
| 2,731,245 | 1/1956 | McChesney | 165/184 |
| 3,424,234 | 1/1969 | Laing | 165/51 |
| 3,835,921 | 9/1974 | Faris et al. | 165/86 |
| 4,076,072 | 2/1978 | Bentz | 165/86 |
| 4,131,157 | 12/1978 | Laing | 165/121 |
| 4,416,223 | 11/1983 | Hashizume | 165/146 |
| 4,877,087 | 10/1989 | Hill | 165/181 |
| 4,934,448 | 6/1990 | Vemura et al. | 165/41 |

FOREIGN PATENT DOCUMENTS

| | | | |
|---|---|---|---|
| 577743 | 8/1932 | Fed. Rep. of Germany | 165/76 |
| 0118595 | 9/1980 | Japan | 165/86 |
| 0162396 | 12/1981 | Japan | 165/181 |
| 0105689 | 7/1982 | Japan | 165/146 |
| 0224296 | 12/1983 | Japan | 165/86 |
| 59-41111 | 10/1984 | Japan . | |
| 60-23277 | 6/1985 | Japan . | |
| 380992 | 9/1932 | United Kingdom | 165/86 |
| 1600404 | 10/1981 | United Kingdom | 165/86 |

*Primary Examiner*—John Ford

*Attorney, Agent, or Firm*—Leydig, Voit & Mayer

[57] ABSTRACT

A rotary heat exchanger has a plurality of arcuate hollow blow blades with extend between first and second rotating bodies and which conduct liquid from one to the other. Each of the blades is provided with its own set of fins which are arranged to interleave between and overlap those on the adjacent blades. The rotating bodies are constructed to define inlet and outlet chambers therein. Bearings which are disposed between stationary inlet and outlet pipes and the first and second rotating bodies protect seals from damaging forces when the device is rotating.

8 Claims, 4 Drawing Sheets

ROTARY HEAT EXCHANGER

BACKGROUND OF THE INVENTION

1. Field of the Invention

The present invention relates to a rotary heat exchanger and more specifically to a rotary heat exchanger which exhibits good heat exchange characteristics and has an improved seal and bearing structure.

2. Description of the Prior Art

Japanese Published Unexamined Patent Application Nos. -59-41111 and -60-23277 disclose rotary heat exchangers like the one shown in FIGS. 1 and 2. This type of device includes an inlet port 1 through which fluid F is supplied to a supply chamber 2. A seal arrangement 3 supports a supply conduit 4 in a manner wherein the upstream end of the conduit 4 is placed in fluid communication with the supply chamber 2. The downstream end of the supply conduit 4 communicates with an essentially annular rotatable supply header 5. A plurality of hollow blower blades are arranged to establish fluid communication between the outer peripheral portion of the supply header 5 and the corresponding portion of a rotatable exhaust header 7. An exhaust conduit 8 is arranged to communicate at its upstream end with the exhaust header 7 and to be rotatably supported by seal arrangements 9 and 10 in an exhaust chamber 11. The portion of the exhaust conduit 8 defined between the two seal arangements 9 and 10 is apertured so that the fluid which is supplied into the exhaust header 7 can be discharged into the exhaust chamber 11 and subsequently drained therefrom via an outlet conduit 12.

The hollow blower blades 6 are provided with a plurality fins 13 which improve the heat exhange efficiency of the arrangement. A motor 14 is operatively connected to an end portion of the exhaust conduit 8. When this motor 14 is energized the rotary headers 5 and 7 and interconnecting hollow blower blades 6 are induced to rotate and define a rotary blower arrangement.

However, this arrangement has the drawbacks that both the fins 13 which are either in the form of circular or annular plates and the hollow blower blades 6 must be precisely formed and assembled in order to achieve a good fit and balance of the rotating parts. This of course makes their production and assembly time-consuming, which, in combination with the high precision requirements, increases the cost of the device undesirably.

In addition, as air has a finite viscosity, a boundary layer tends to be formed over the surface of the fins 13 and reduces the amount of heat exchange with the air passing through the device. However, if the number of fins 13 are increased to improve this situation, the surface area of the blower blades 6 actually available for inducing the necessary flow of air through the device tends to be reduced and therefore reduces the amount of air which is blown through. This therefore limits the number of additional fins which can be added and therefore causes a number of design limitations.

Further, the seal arrangements 3, 9 and 10 which are provided in order to prevent leakage of the fluid being cooled, are subject to vibration and radially acting forces due to the inevitable slight imbalance in the rotating parts of the device, and tend to readily deteriorate to the point of permitting leakage to occur.

SUMMARY OF THE INVENTION

It is an object of the present invention to provide a heat exchanger of the above-mentioned rotating blower type which has a structure which permits ready fabrication and assembly and which features good heat exchange efficiency.

In brief, the above object is achieved by an arrangement which features a plurality of arcuate hollow blow blades with extend between first and second rotating bodies and which conduct liquid from one to the other. Each of the blades is provided with its own set of fins which are arranged to interleave between and overlap those on the adjacent blades. The rotating bodies are constructed to define inlet and outlet chambers therein and have bearings disposed between stationary inlet and outlet pipes and the first and second rotating bodies which protect seals from damaging forces when the device is rotating.

A rotary heat exchanger according to a first aspect of the present invention comprises first and second rotatable bodies, the defining therein inlet and outlet chambers respectively, the first and second rotatable bodies being arranged to be rotatable about a common axis and spaced from one another along the axis. A plurality of conduits lead from the first rotatable body to second rotatable body, the and fluidly interconnect the inlet and outlet chambers; and a plurality of fins provided on each of the conduits. The fins being arranged so that the fins on one conduit interleave with and overlap the fins formed on the conduits located on either side of the one conduit.

A heat exchanger according to the present invention may further include: a stationary inlet pipe which fluidly communicate with the inlet chamber, a first bearing operatively disposed between the inlet pipe and the first rotatable body; a stationary outlet pipe which fluidly communicates with the outlet chamber, a second bearing operatively disposed between the outlet pipe and the second rotatable body; a first seal disposed on the inlet pipe to prevent fluid in the; and a second seal disposed on the outlet pipe to prevent fluid in the outlet chamber from leaking out therefrom second bearing protecting the second seal from forces the first and second bearings protect the seals from forces produced during rotation of the heat exchanger.

An engine cooling arrangement according to the present invention comprises an engine compartment; an engine disposed in the engine compartment; a rotary heat exchanger disposed in the engine compartment, and; a duct disposed about the rotary heat exchanger. The duct guides the air which passes through the rotary heat exchanger out of the engine compartment without contacting the engine.

DETAILED DESCRIPTION OF THE PREFERRED EMBODIMENTS

Figure 3:
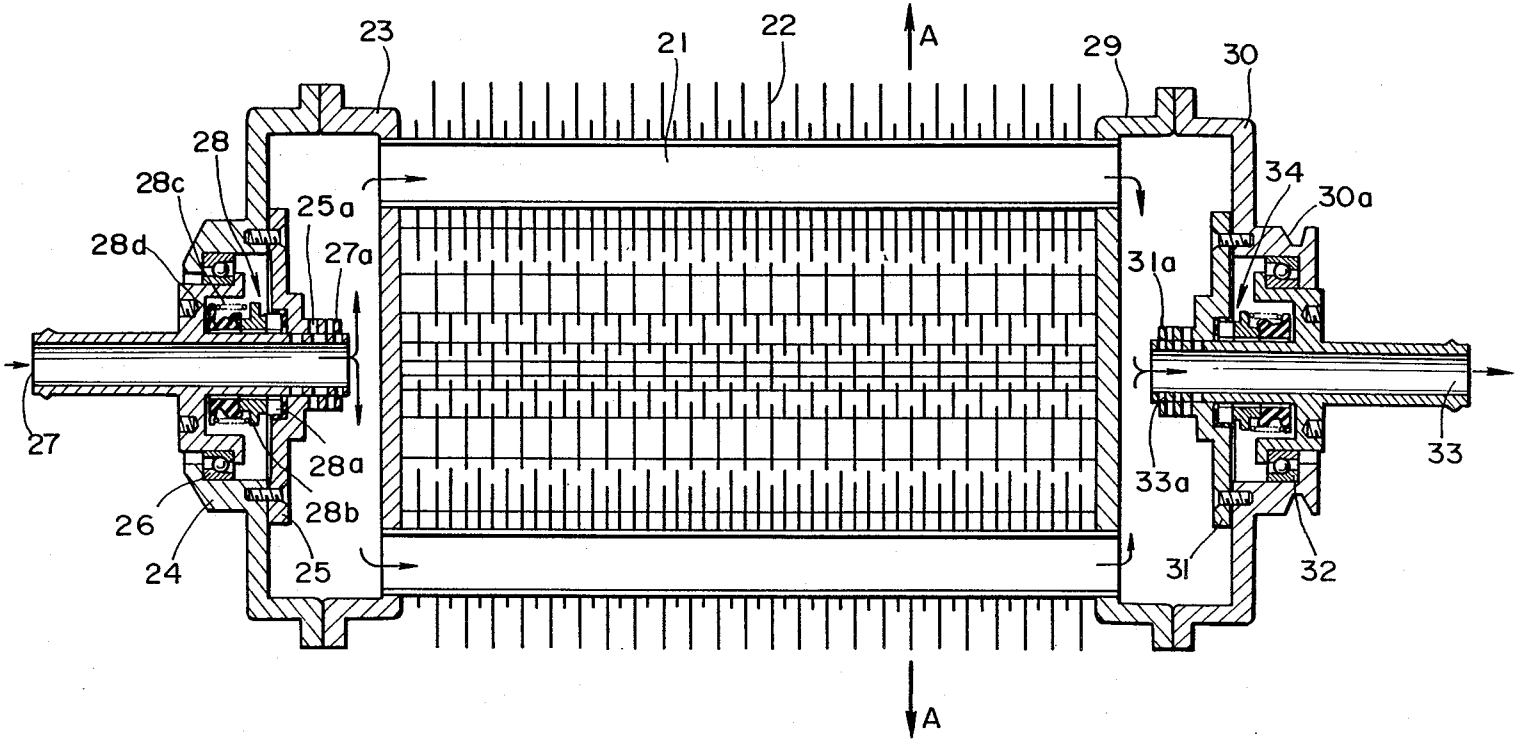
FIG. 3 is a front sectional elevation of an embodiment of a rotary heat exchanger according to the present invention.
Figure 4:
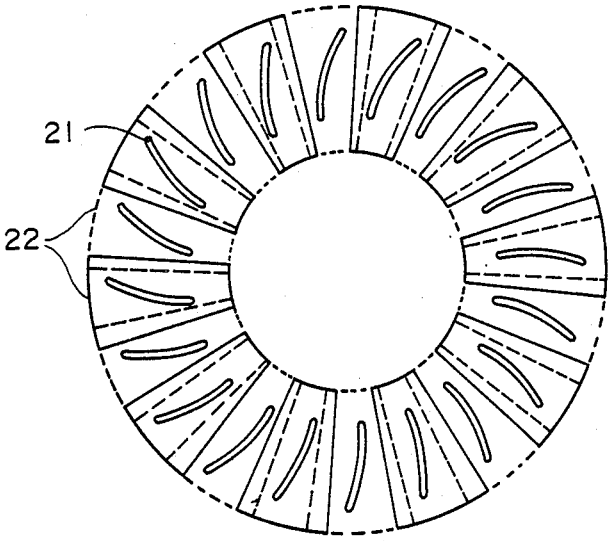
FIG. 4 is a side sectional view taken along line A—A of FIG. 3.
Figure 5:
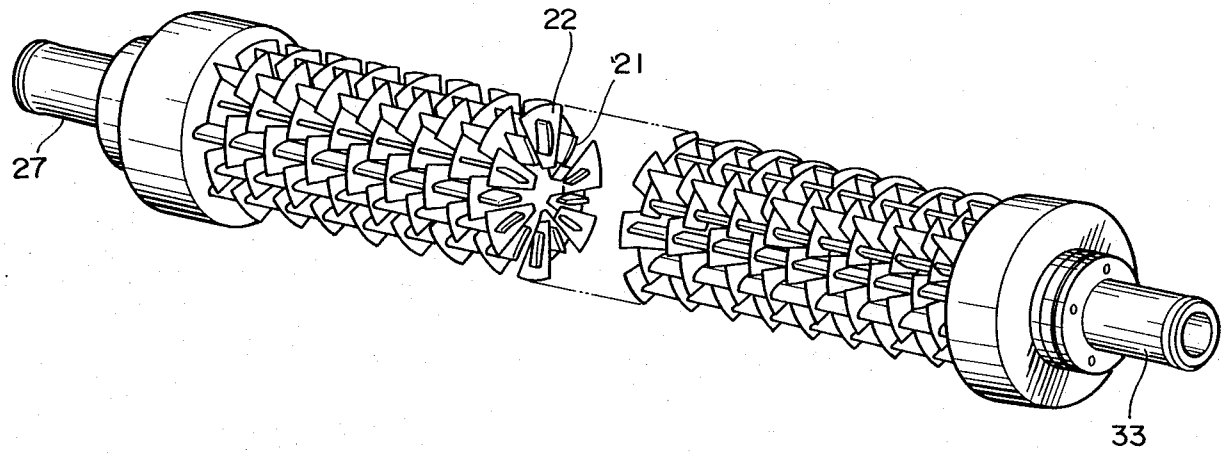
FIG. 5 is a perspective view of the embodiment of FIG. 3.

FIGS. 3 to 5 show an embodiment of the present invention. This arrangement comprises a plurality of hollow arcuate blower blades 21 (see FIG. 4) on which a plurality of radially extending fins are disposed. The blower blades 21 are arranged in an annular pattern and extend between and fluidly communicate between first and second end plate members 23 and 29.

Both of the end plates 23, 29 are dish-shaped and cooperate with covers 24, 30 to define an enclosed space. Circular closure plates 25, 31 are sealingly connected to the inner faces of the covers 24, 30 respectively, in a manner to define inlet and outlet chambers. Each of the circular closure plates 25, 31 has at is center an inwardly projecting boss in which concentric bore is formed.

Stationary inlet and outlet pipes 27, 33 support the above-mentioned structure by roller bearings 26, 32. Each of the inlet and outlet pipes includes a portion which is received in the bore of the boss of the corresponding closure plate. These portions have small diameter radial bores 27*a* and 33*a* while the corresponding bosses have corresponding radial bores 25*a* and 31*a* formed therein. The two sets of bores are offset with respect to one and other and allow the liquid which is flowing through the heat exchanger to form a liquid layer between the stationary inlet and outlet pipes and the rotating bosses in a maner which provides a kind of lubricating action.

Seal members generally denoted by numerals 28 and 34 are disposed about each of the inlet and outlet pipes 27, 33. These seal members are located in an annular chamber defined between the outboard faces of the circular plates 25, 31 and radially extending flange members which support the roller bearings 26, 32. Both of the seals are of identical construction and for simplicity only the seal arrangement provided at the inlet end of the device will be described.

The above-mentioned seal 34 comprises a floating seal member 28*a*, a carbon seal 28*b*, a spring 28*c* and a shaft seal 28*d*. The annular floating seal member 28*a* is disposed in an annular recess formed in the outboard face of the plate 25. The carbon seal 28*b* abuts the outboard edge of the floating seal member and is biased against it by the spring 28*c* which engages the shaft seal 28*d* at the other end.

The provision of the roller bearings 26 about the seals prevents the seal arrangements from being exposed to loads such as radial acting forces and vibrations produced by the rotation of the heat exchanger and thus ensures the longevity and effectiveness of the seals.

In order to provide a drive connection between a source of rotational energy such as the crankshaft of an internal engine or electric motor, a V-shaped recess 30*a* is formed in the cover 30. This recess enables a V-belt to be operatively connected to the cover 30 and to enable the heat exchange unit which is defined between the inlet and outlet pipes 27 and 33 to be rotated at a selected rotational speed.

It is course possible to provide the drive connection at the inlet pipe end if so desired. Alternative drive arrangements are also possible.

Figure 6:
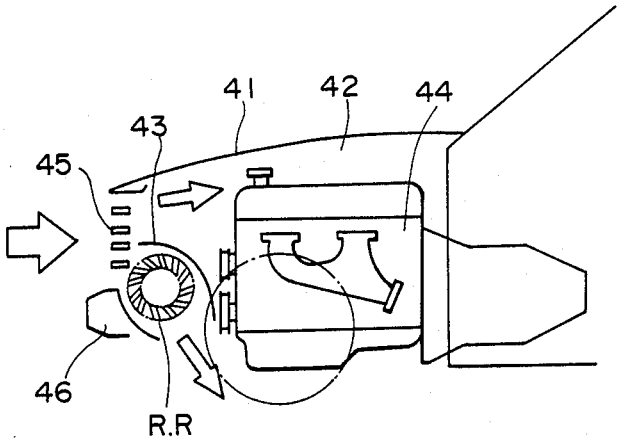
FIG. 6 is a schematic view showing the embodiment of FIG. 3 as applied to the cooling system of an automotive vehicle.

The above described arrangement can be utilized as a radiator for an automotive engine as shown in FIG. 6. In this figure, element number 41 an engine bonnet or hood, 42 is an engine compartment, 43 is a duct structure in which the rotary heat exchanger R.R according to the present invention is disposed, 44 is an automotive engine which is fluidly communicated with the heat exchanger in a manner which allows engine coolant to be circulated therethrough, 45 is a radiator grill or the like through which air can flow into the engine room 42, and 46 is a bumper.

As indicated by the large arrows, the air which flows through the grill 45 is split into two main flows, one of which actually enters the engine compartment 42 and the other of which flows through the duct 43 in which the rotary heat exchanger R.R is disposed. This flow division serves to direct the air which contains the heat extracted from the engine coolant by the heat exchanger R.R directly out of the engine compartment thus prevents the engine 44 from being exposed to the flow of hot air, which would tend to reheat the engine 44 and defeat the operation of the heat exchanger.

The air which does pass over the engine is essentially at ambient temperature and is able to more effectively remove heat from the engine and various devices are mounted on the engine and are equipped with heat susceptible elements such as fan belts, and fuel injection lines thereon.

In operation, the heated coolant is pumped from the engine by a coolant pump (not shown) and passed through the inlet pipe 27 into the inlet chamber. A drive connection (e.g. a v-belt) rotates the rotatable portions of the heat exchangers. The hot liquid introduced into the inlet chamber flows radially outwardly and enters the hollow blower blades 21. As the fluid flows through these blades, 21 the heat in the liquid is transferred to the cooler metal sheeting from which the blades 21 are formed and into the cooling fins 22 and thereafter is conducted to the cooling fins 22. As indicated by the arrows, the fluid which flows through the hollow blower blades 21 enters the outlet chamber and thereafter passes out through the outlet pipe 33 and returns to the engine coolant jacket.

Figure 1:
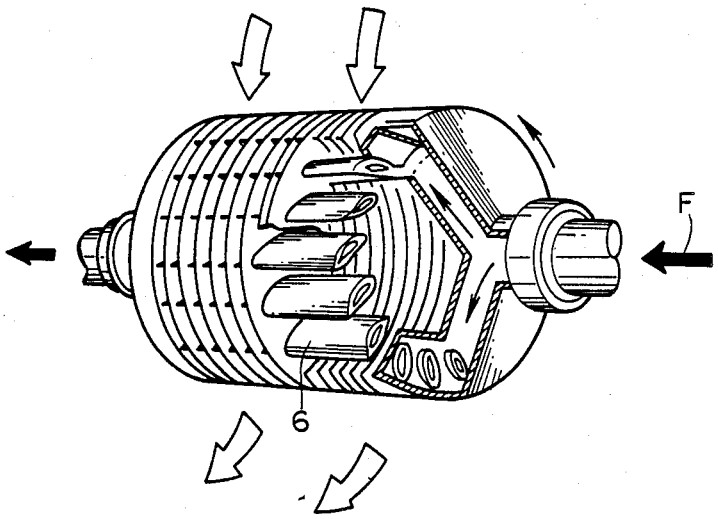
FIG. 1 (PRIOR ART)
FIG. 1 is a perspective view of a prior art rotary heat exchanger.
Figure 2:
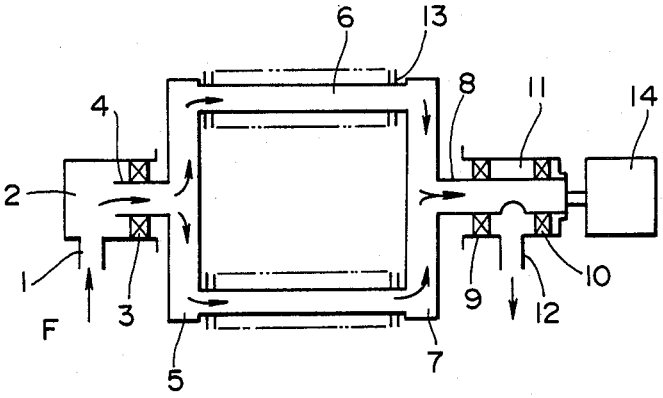
FIG. 2 (PRIOR ART)
FIG. 2 is a schematic elevational view showing the basic construction of the device shown in FIG. 1.

Due to the arcuate shape of the hollow blower blades 21 (see FIG. 4) air is induced to both blow through the device and pass over the surface of the blades 21 and the cooling fins 22. Further, as the cooling fins 22 are each relatively small, the layer of air which tends to form on the fins 22 is prevented from being excessively thick. Therefore, the fins 22 can perform the expected amount of fanning action. In addition, as the fins 22 are staggered and overlap one another (see FIG. 5 for example) it is possible to increase the surface area of the fins 22 which is available for heat exchange as compared with the prior art arrangement shown in FIG. 1. It is also possible additionally increase the amount of air which flows through and over the rotating blower blades 21. This improves the efficiency with which heat can be exchanged between the engine coolant and the ambient atmosphere.

The above-described arrangement also renders it possible to more readily manufacture and assemble the device. Namely each of the blower blades 21 can be produced and provided with the cooling fins 22 prior to connection with the end plates 23, 29. Connection with the end plates is also rendered easier in that it is not necessary to precisely locate the blower blades 21 with respect to circular perforate plates as in the prior art.

The bearing/seal arrangement, as mentioned above, provides a strong and durable arrangement which is resistant to wear and subsequent leakage and which ensures smooth rotation of the device.

Another benefit of the present invention is that it is possible to arrange the heat exchanger across a front of the vehicle and readily connect the heat exchanger to a source of rotational energy (particularly in the case of transversely arranged engines). Further, due to the essentially cylindrical elongated configuration of the device (see FIG. 5) it is possible to dispose the heat exchanger at a low level, such as near the vehicle bumper, and thus it is possible to lower the profile of the front portion of the engine compartment in a manner not possible when conventional stationary upright type radiators are used. This enables the front of the vehicle to be lowered and reduces the air resistance and drag characteristics of the vehicle.

What is claimed is:

1. A rotary heat exchanger comprising:

first and second rotatable bodies having inlet and outlet chambers, respectively, formed therein, said first and second rotatable bodies being disposed on a common axis and spaced from one another along said axis;

a plurality of conduits which lead from said first rotatable body to said second rotatable body and fluidly interconnect said inlet and outlet chambers;

a plurality of fins, each of which is mounted on only one of said conduits, said fins being arranged so that the fins on one conduit interleave with and overlap the fins formed on the conduits located on either side of said one conduit and so that the fins on alternate conduits are aligned with one another;

a stationary inlet pipe which fluidly communicates with said inlet chamber and has a first radially-extending flange having a first axially-extending lip portion;

a first bearing which is disposed between said first lip portion and said first rotatable body and which rotatably supports said first rotatable body on said first lip portion;

a stationary outlet pipe which fluidly communicates with said outlet chamber and has a second radially-extending flange having a second axially-extending lip portion;

a second bearing which is disposed between said second lip portion of said outlet pipe and said second rotatable body and which rotatably supports said second rotatable body on said second lip portion;

a first seal which is disposed on said inlet pipe and partially enclosed by said first lip portion; and a second seal which is disposed on said outlet pipe and partially enclosed by said second lip portion.

2. A rotary heat exchanger as claimed in claim 1 further comprising:

a duct which is disposed around said first and second rotatable bodies and said interconnecting conduits and which has an inlet and an outlet through which air can pass through said duct over said conduits.

3. A rotary heat exchanger as claimed in claim 2 wherein said interconnecting conduits have arcuate shapes which force air through said duct when said first and second rotatable bodies are rotated.

4. A rotary heat exchanger comprising:

first and second rotatable bodies which have inlet and outlet chambers, respectively, formed therein and which are disposed on a common axis and spaced from one another along said axis;

a plurality of conduits which lead from said first rotatable body to said second rotatable body and fluidly interconnect said inlet and outlet chambers; and a plurality of fins, each of which is mounted on one of said conduits, said fins being arranged so that the fins on one conduit interleave with and overlap the fins formed on the conduits located on either side of said one conduit;

a stationary inlet pipe which communicates with the inlet chamber; and a stationary outlet pipe which communicates with the outlet chamber, wherein said first and second rotatable bodies respectively comprises:

first and second end plates having a dished configuration;

first and second covers which together with said first and second end plates define first and second enclosed spaces;

first and second closure plates disposed in said first and second enclosed spaces, respectively, said first closure plate partitioning said first enclosed space into the inlet chamber and a first seal chamber and said second closure plate partitioning said second enclosed space into the outlet chamber and a second seal chamber, said first and second closure plates having first and second boss portions in which first and second bores are formed, respectively, said first bore receiving a portion of said inlet pipe and said second bore receiving a portion of said outlet pipe in a manner such that said inlet and outlet pipes fluidly communicate with said inlet and outlet chambers, respectively;

a first bearing which is disposed between said first cover and said inlet pipe and rotatably supports said first cover on said inlet pipe and a second bearing which is disposed between said second cover and said outlet pipe and rotatably supports said second cover on said outlet pipe;

first and second seal arrangements disposed on said inlet and outlet pipes inside said first and second seal chambers, respectively, for preventing leakage of fluid from said inlet and outlet chambers via said first and second bores;

a first set of small diameter bores formed in said first boss portion;

a second set of small diameter bores formed in said second boss portion;

a third set of small diameter bores formed in the section of said inlet pipe which is received in the bore formed in said first boss portion and offset with respect to the first set of small diameter bores; and a fourth set of small diameter bores formed in the section of said outlet pipe which is received in the bore formed in said second boss portion and offset with respect to the second set of small diameter bores.

5. A rotary heat exchanger comprising:

first and second rotatable bodies having inlet and outlet chambers, respectively, formed therein, said first and second rotatable bodies being disposed on a common axis and spaced from one another along said axis;

a plurality of conduits which are arranged in an annular pattern about said axis and lead from said first rotatable body to said second rotatable body and fluidly interconnect said inlet and outlet chambers; and a plurality of fins, each of which is mounted on only one of said conduits, said fins being arranged so that the fins on one conduit interleave with and overlap the fins formed on the conduits located on either side of said one conduit and so that the fins on alternate conduits are aligned with one another, each of said fins having a shape which is essentially a sector of a ring.

6. A rotary heat exchanger as claimed in claim 1 further comprising means for producing a lubricating film between said inlet pipe and said inlet chamber using a fluid introduced into said inlet chamber.

7. A rotary heat exchanger as claimed in claim 1 further comprising means for producing a lubricating film between said outlet pipe and said outlet chamber using a fluid introduced into said outlet chamber.

8. A rotary heat exchanger comprising:

first and second rotatable bodies which have inlet and outlet chambers, respectively, formed therein and which are disposed on a common axis and spaced from one another along said axis;

a plurality of conduits which lead from said first rotatable body to said second rotatable body and fluidly interconnect said inlet and outlet chambers; and a plurality of fins, each of which is mounted on only one of said conduits, said fins being arranged so that the fins on one conduit interleave with and overlap the fins formed on the conduits located on either side of said one conduit and so that the fins on alternate conduits are aligned with one another;

a stationary inlet pipe which communicates with the inlet chamber;

a stationary outlet pipe which communicates with the outlet chamber;

a first closure plate which partitions said first rotatable body into the inlet chamber and a first seal chamber and which has a bore through which said inlet pipe passes;

a second closure plate which partitions said second rotatable body into the outlet chamber and a second seal chamber and which has a bore through which said outlet pipe passes;

a first bearing which journals said first rotatable body on said inlet pipe;

a second bearing which journals said second rotatable body on said outlet pipe;

a first seal which is disposed in said first seal chamber and forms a seal between the periphery of said inlet pipe and the bore of said first closure plate; and a second seal which is disposed in said second seal chamber and forms a seal between the periphery of said outlet pipe and the bore of said second closure plate.

* * * * *